US005330105A

United States Patent [19]

Kaylor

[11] Patent Number: 5,330,105

[45] Date of Patent: Jul. 19, 1994

[54] ASPIRATING NOZZLE AND ACCESSORY SYSTEMS THEREFOR

[75] Inventor: Joseph B. Kaylor, Manassas, Va.

[73] Assignee: Valkyrie Scientific Proprietary, L.C., Manassas Park, Va.

[21] Appl. No.: 37,647

[22] Filed: Mar. 26, 1993

[51] Int. Cl.[5] ..... B05B 1/34; B05B 7/00

[52] U.S. Cl. ..... 239/400; 239/407; 239/427.3; 239/428; 239/428.5; 239/433; 169/15; 222/82; 137/893; 137/889

[58] Field of Search ..... 239/8, 9, 10, 399, 400, 239/403, 405, 407, 413, 416.5, 427.3, 427.5, 428, 428.5, 433, 463, 498, 525, 154, 152, 704, 153; 169/70, 15, 14; 222/81, 82, 386, 386.5, 105; 137/888, 889, 890, 892, 893

[56] References Cited

U.S. PATENT DOCUMENTS

| | | | |
|---|---|---|---|
| 1,138,500 | 5/1915 | Naylor | 239/154 X |
| 2,089,646 | 8/1937 | Friedrich | 169/15 X |
| 2,603,469 | 7/1952 | Bedford et al. | 239/428.5 X |
| 3,413,385 | 11/1968 | Komac et al. | 239/433 X |
| 3,809,524 | 5/1974 | Bruhlet et al. | 239/433 X |
| 4,086,937 | 5/1978 | Hechler, IV | 137/888 X |
| 4,484,710 | 11/1984 | Rozniecki | 239/428.5 X |
| 4,530,468 | 7/1985 | Sperber | 239/433 X |
| 4,629,094 | 12/1986 | Vogel et al. | 222/82 |
| 4,741,155 | 5/1988 | McCarty | 222/82 X |
| 4,828,038 | 5/1989 | Williams | 169/15 |
| 5,054,688 | 10/1991 | Grindley | 239/407 |
| 5,137,094 | 8/1992 | Broussard | 169/15 |
| 5,190,217 | 3/1993 | Black et al. | 239/154 |

FOREIGN PATENT DOCUMENTS

| | | | |
|---|---|---|---|
| 1070250 | 7/1954 | France | 222/81 |
| 1226484 | 7/1960 | France | 239/152 |
| 2143153 | 2/1985 | United Kingdom | 239/704 |

*Primary Examiner*—Andres Kashnikow
*Assistant Examiner*—Lesley D. Morris
*Attorney, Agent, or Firm*—Roland H. Shubert

[57] ABSTRACT

An air aspirating nozzle for propelling a stream of foam or a slurry of solid particulates to a target surface includes a stream shaping member within the nozzle to form a rotating, columnar stream of liquid and air which maintains a high degree of coherence over a considerable throw distance. The nozzle assembly may include a flow control unit for the introduction of a foam concentrate or a fluid suspension of particulate solids into the nozzle.

27 Claims, 5 Drawing Sheets

ASPIRATING NOZZLE AND ACCESSORY SYSTEMS THEREFOR

TECHNICAL FIELD

This invention relates generally to a gas aspirating nozzle and to accessory systems for providing a supply of liquids and solids to the nozzle.

Specific embodiments of this invention include air aspirating fire fighting nozzles to propel a stream of water or water mixed with foam forming constituents to a fire source as well as air aspirating nozzles adapted to propel a slurry of water and particulate solids to impact upon a solid surface.

BACKGROUND ART

There have been a wide variety of nozzles which have been developed for use in fighting fires and for the production of foams for other purposes. Certain of such nozzles use only water as the extinguishing agent and have come to be known as fog nozzles. Those nozzles produce a dispersed spray of small water droplets projected from the nozzle tip in a generally conical pattern. An example of one such nozzle is described in U.S. Pat. No. 4,653,693.

A second type of nozzle commonly use in fire fighting is the air aspirating foam nozzle and a variety of such nozzles are described in the patent literature. Examples include U.S. Pat. No. 5,058,809 to Carroll et al; U.S. Pat. No. 5,054,688 to Grindley; and U.S. Pat. No. 830,790 to Stevenson. The nozzles described in those exemplary patents all have in common means to aspirate air into a solution of foaming agent and water. Turbulence producing means are provided within the nozzle body to mix the air and liquid to produce a foam which is projected from the nozzle end.

A nozzle which might be considered a variation on those of the air aspirating type is disclosed in U.S. Pat. No. 5,113,945 to Cable. The Cable patent describes a foam producing nozzle which is supplied air from a pressurized source rather than aspirating atmospheric air for foam production as do the nozzles described in the patents cited above.

Yet other nozzles are of the multifunction type. Those are illustrated by a patent to Steingass, U.S. Pat. No. 4,944,460 and a second patent to Williams et al, U.S. Pat. No. 5,167,285. The nozzle described in the Steingass patent is adapted to spray either water or a mixture of water and a foam concentrate, is adjustable between a straight stream and fog positions, and can be set to pull atmospheric air into the nozzle and mix it with liquid to form a foam. The Williams et al patent describes a nozzle which has provision for simultaneously discharging a dry powder and a stream of water or water based foam. The dry powder is discharged from a central, axially extending conduit while the liquid stream is discharged in an annular pattern around the stream of discharging powder. The powder, if it mixes at all with the liquid, does so after leaving the nozzle and at some distance therefrom.

Despite the variety of specialized nozzles and extinguishing agent delivery systems known in the prior art, the need for a simple high performance nozzle system capable of operating over a range of water pressures, and especially at low water pressures, to project an air aspirated stream of water or water-foam concentrate for considerable distances has not been met. Further, the art lacks a simple yet reliable system for continuously feeding particulate solids into a flowing liquid stream and thence through a nozzle without the hazard of bridging and clogging. Applicant's nozzle and accessory system meets those needs.

DISCLOSURE OF THE INVENTION

This invention provides a nozzle and accessory systems having the capability of projecting a tight, coherent, air-aspirated stream of water, water-foam concentrate or a water-solids slurry for a considerable distance to obtain a very short, narrow footprint, or discharge pattern, at the landing point of the liquid stream. Also provided are means to supply either a liquid, which may be a foam concentrate, or a particulate solid, which may be a fire extinguishing agent or an abrasive material, to the nozzle. The nozzle itself includes a tubular body having a stream shaping member disposed axially therein. That stream shaping member defines an annular zone of reduced cross section at the upstream end of the nozzle thereby creating a zone of reduced pressure into which air is aspirated through ports in the nozzle wall. Water or other liquid entering the nozzle is forced to the inner surface of the nozzle wall forming a layer to which a spin is imparted by vane members which also support the stream shaping member axially within the nozzle. Air passes through the liquid stream and travels out of the nozzle end as the central core of a rotating columnar water stream.

Accordingly, it is an object of this invention to provide an improved air aspirating nozzle having the capability of propelling a columnar stream of air-aspirated liquid or liquid and solids onto a fire or other target.

It is a further object of this invention to provide an air-aspirating nozzle having means to introduce either a liquid foam concentrate or a steam of particulate solids into the nozzle to be mixed therein with a stream of water supplied to the nozzle.

Yet another object of this invention is to provide improved means and methods for extinguishing fires.

Other objects will become apparent to one skilled in the art from the following description of various modes for carrying out the invention.

MODES FOR CARRYING OUT THE INVENTION

Figure 1:
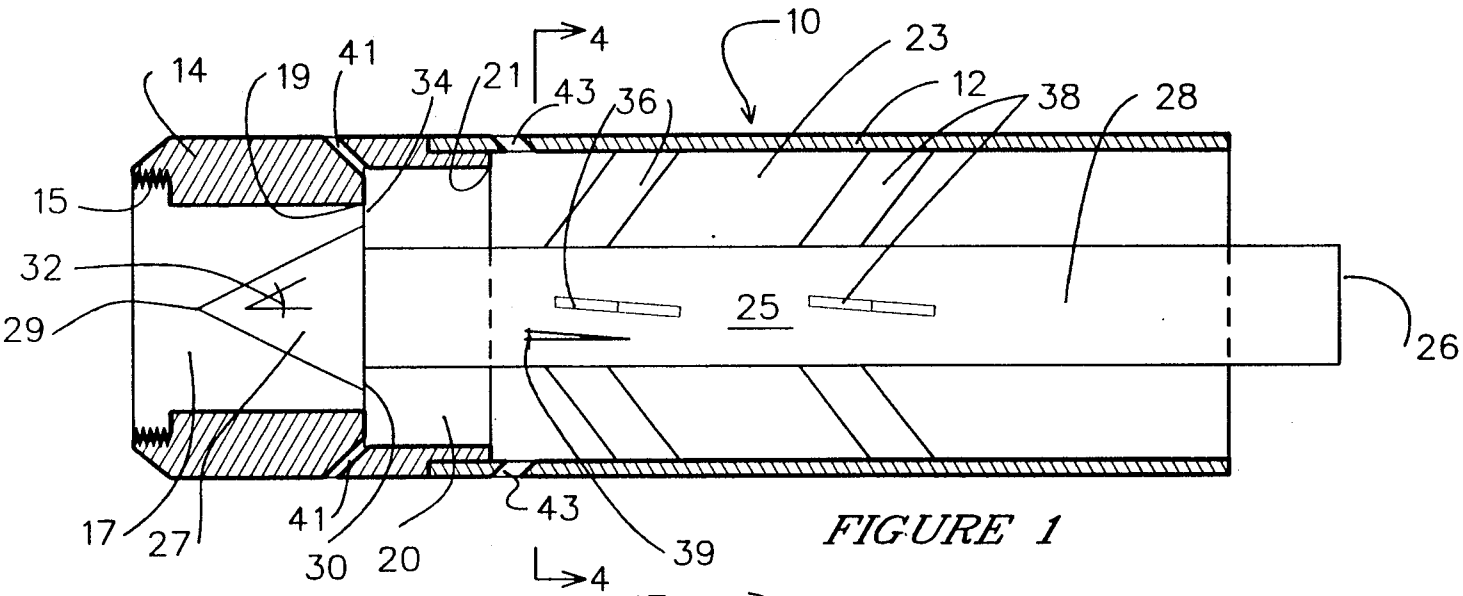
FIG. 1 is a longitudinal sectional view of the air aspirating nozzle of this invention.

Various embodiments of the invention will be described and discussed in detail with reference to the drawing figures in which like reference numerals refer to the same component or part illustrated in different figures.

Referring first to FIG. 1, there is shown generally at 10 a sectional view of the air aspirating nozzle of this invention. The nozzle itself includes a generally tubular body 12 and a head member 14 of smaller internal diameter than body 12. Head member 14 is adapted for connection to a flow control valve or other accessory at its upstream end through threaded connector portion 15 and forms a generally cylindrical passage 17 downstream of connector 15. The wall of passage 17 preferably tapers inwardly so as to be of progressively smaller cross sectional area downstream of connector 15 to shoulder 19.

At shoulder 19 the diameter of passage 17 increases to form a first zone 20 of enlarged cross sectional area. A second shoulder 21 may be provided a short distance, typically less than the diameter of zone 20, downstream of shoulder 19 to form a second zone 23 of yet larger cross sectional area. Zone 23 is defined by the interior wall of tubular body 12 and extends to the discharge end of the nozzle. The length of the second zone 23 must be greater than its diameter and preferably is between two and ten times its diameter.

A stream shaping means 25 having an end 26, a head member 27, and a body portion 28 is positioned axially within the nozzle. Head member 27 must be a symmetrical body enlarging from forward end 29 to base 30 and preferably is configured as a cone having an apex angle 32 less than 75° and most preferably less than 30°. While a conical configuration is preferred for head member 27, it may also be configured as a hemisphere or parabola or other curve. The forward end 29 of head member 27 is positioned to extend into passage 17 while base 30 is positioned adjacent shoulder 19 or just downstream therefrom. By so positioning base 30 relative to shoulder 19 there is formed an annular fluid channel 34 communicating between passage 17 and first zone 20. The dimensions of base 30 relative to the diameter of passage 17 at shoulder 19 are set such that the area encompassed by channel 34 is substantially smaller than is the cross sectional area of passage 17 at that same point. In a preferred embodiment, the area of channel 34 is less than one-half, and most preferably, about than one-third the cross sectional area of passage 17.

The body portion 28 of stream shaping means 25 comprises a cylinder extending axially from base 30 to a point adjacent the end of tubular body 12 and preferably extending beyond the end of body 12 as is shown in the drawing. Diameter of the cylindrical body portion 28 must be no greater than that of base 30 and appropriately is some 60% to 90% that of base 30. A set of upstream forward vanes 36 and a set of downstream rearward vanes 38 extend between and are fixed to the outer surface of body portion 28 and the inner wall of tubular body 12 so as to hold stream shaping means 25 in a fixed position within nozzle 10. Each set of vanes 36 and 38 consist of a plurality, preferably three or four, individual vane members disposed at a slight angle 39 to the axis of the nozzle. That vane angle 39 is set so as to give a twist or rotation to fluid passing through the nozzle much as does the rifling in an artillery piece. Angle 39 is uniform for all vane members and is preferably set at less than about 10° so as to give one full rotation to a fluid column expelled from the nozzle for every 10 to 50 nozzle diameters.

Figure 5:
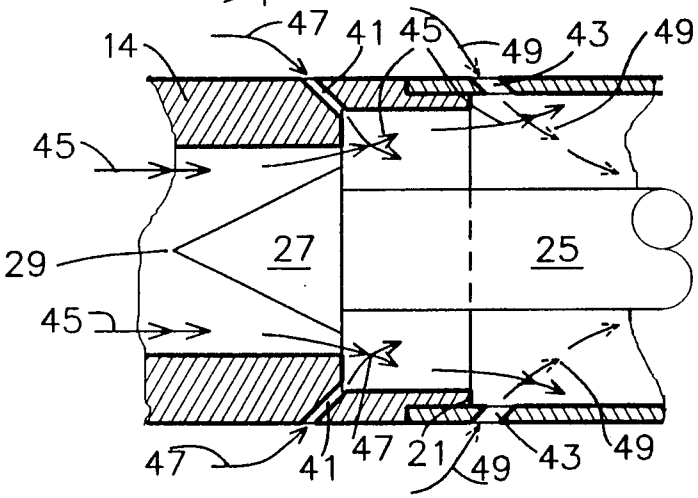
FIG. 5 is a diagrammatic sectional view showing the flow of liquid and gas within the nozzle.

Referring now to FIG. 5 as well as to FIG. 1, air or other gas is aspirated into the nozzle by way of primary ports 41 which are spaced around the periphery of head member 14 to enter the nozzle interior at or adjacent first shoulder 19. Additional air may be aspirated into the nozzle further downstream through a set of secondary ports 43 positioned at or adjacent second shoulder 21. A liquid stream which may be water or water mixed with a foam concentrate from a source which may be a water main or pump is supplied to the nozzle and flows in the path indicated by the double headed arrows 45. As the water passes through channel 34 its velocity is increased because of the constricted area defined by the channel as compared to upstream passage 17. The liquid flow is also directed to the periphery of zone 20 by acting against the surface of head member 27 and, in passing shoulder 19, creates a reduced pressure zone, or partial vacuum, just downstream of base 30 and adjacent the surface of the cylindrical body portion 28 of stream shaping means 25. In order to reach that zone of reduced pressure, air flows in a pattern depicted by the single headed arrows 47 crossing through that layer of liquid flowing through fluid channel 34 to the periphery of zone 20. In so doing intense mixing of the air and liquid occurs and, if the liquid comprises a mixture of water and foam concentrate, a dense foam is produced.

Figure 6:
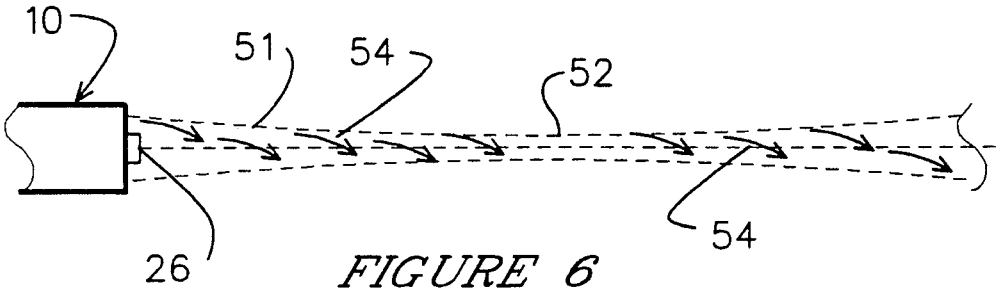
FIG. 6 is an illustration of the column of liquid and gas projected out of the nozzle of FIG. 1.

The provision of secondary ports 43 in association with second shoulder 21 results in the creation of another zone of reduced pressure, or partial vacuum, just downstream of shoulder 21. Air entering through secondary ports 43 again has to pass through a layer of flowing liquid in the path depicted by arrows 49 resulting in further intense mixing of the air and liquid. The air and liquid streams tend to form a columnar arrangement as the streams progress through the nozzle body with the liquid forming a ring or wall surrounding an air core. A twist or spin is imparted to both the liquid and the gas streams as they pass first the forward set of vanes 36 and then the rearward set of vanes 38. Referring now to FIG. 6 as well, as a columnar stream of liquid and air 51 leaves the nozzle and progresses beyond the end 26 of stream shaping means 25, it tends to further reduce in diameter for a considerable distance, typically some 5 to 20 feet beyond the nozzle end, to point 52. Thereafter, columnar stream 51 tends to gradually enlarge in diameter. All the while, stream 51 is rotating in the manner shown by arrows 54 as is clearly evident through observation using high speed photography. As the stream 51 impacts upon a surface, the air core within the liquid column again must interact with the liquid layer resulting in a much more "active" water or foam impact than is produced by conventional nozzles. The twisting, or rifling, effect imparted to stream 51 by its passage through the nozzle 10 also results in a throw distance considerably greater than that obtainable using conventional air aspirating nozzles.

Figure 2:
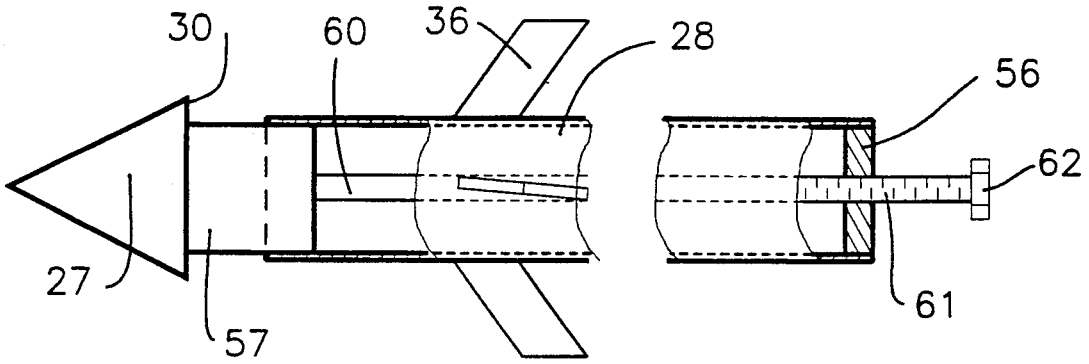
FIG. 2 is a partial sectional view of the stream shaping element of the air aspirating nozzle of FIG. 1.

Turning now to FIG. 2, there is shown an alternative embodiment of the stream shaper means 25'. In this embodiment, body portion 28 comprises a hollow tube having a closure means 56 at the downstream end thereof. Base 30 of head member 27 is mounted upon neck 57 which is adapted to slidingly fit within the end of tubular body 28. A rod 60 is attached to neck 57 and extends the length of tubular body 28 and through closure 56. Rod 60 is threaded at its downstream end 61 and threadably mates with closure 56 so that the effective length of rod 60 between closure 56 and neck 57 is adjustable by turning nut 62 mounted on the end of rod 60. Because tubular body 28 is fixed to the nozzle body 12 through vanes 36, the effect of turning nut 62 is to move head member 27 axially relative to shoulder 19 (see FIG. 1). It has been found that performance of the nozzle, particularly its throw distance, tends to vary with the pressure of liquid fed to the nozzle, and that performance can be optimized by adjustment of base 30 relative to shoulder 19. The embodiment of FIG. 2 allows such adjustment.

Figure 3:
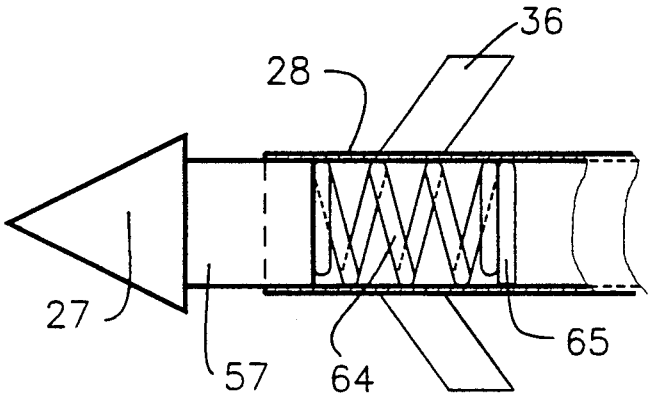
FIG. 3 is a fragmentary sectional view of another embodiment of the stream shaping element.

FIG. 3 illustrates yet another embodiment of the stream shaping means 25. As in FIG. 2, head member 27 is provided with neck 57 which slidingly fits within tubular body member 28. Neck 57 is fixed to one end of a spring 64 which acts under compression to allow head member 27 to move backwardly under a pressure force. The other end of spring 64 rests upon stop means 65 which means are fixed within tube 28. As with the embodiment of FIG. 2, body member 28 is fixed within the nozzle through vanes 36. In operation, the pressure of liquid flowing through the nozzle pushes against head member 27 and tends to move it in the direction of flow by compression of spring 64. The amount of movement increases as fluid pressure increases thus providing an automatic adjustment to optimize nozzle performance over a broad range of operating pressures.

Figure 4:
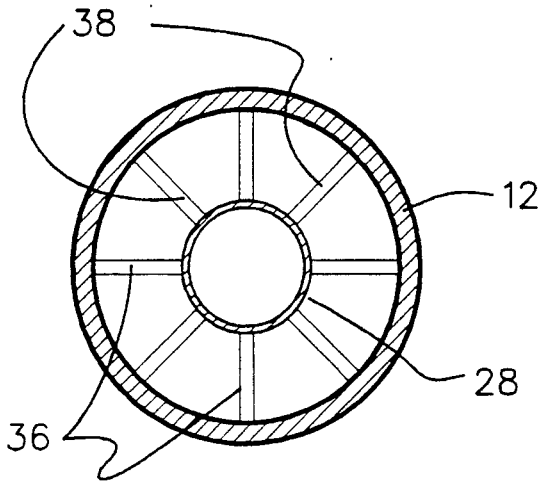
FIG. 4 is a cross sectional view of the nozzle taken along line 4—4 of FIG. 1.

The nozzle embodiment of FIG. 1 has been described as utilizing a forward and a rearward set of vanes to impart a twist to the fluids and to secure stream shaper means 25 within the nozzle. The rearward set of vanes 38 need not be aligned with the forward set of vanes 36. Rather, the two sets of vanes may be rotationally offset as is shown in FIG. 4. Further, rather than providing two sets of vanes, a single set of vanes may be used with some sacrifice in performance and structural strength. Likewise, three or even more sets of vanes, rather than just two, may be used if desired. Other embodiments of this invention may employ but a single set of air aspirating ports rather than two as is depicted in the FIG. 1 embodiment.

Figure 8:
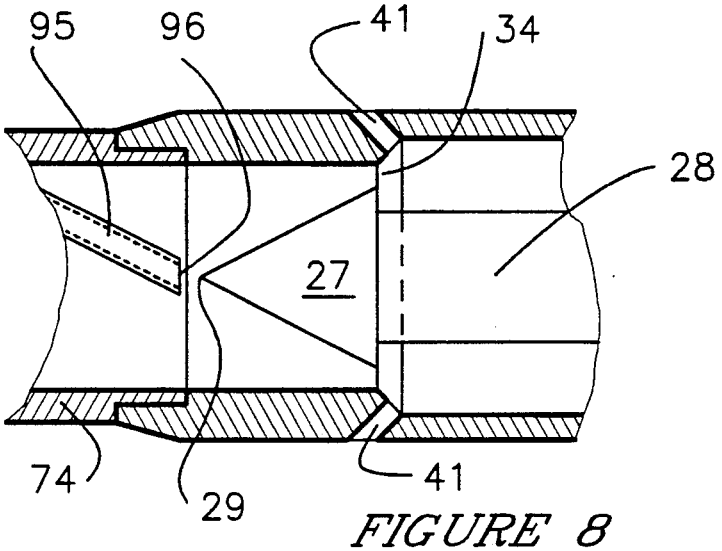
FIG. 8 is a fragmentary sectional view showing a preferred adaptation of the means of FIG. 7 for the introduction of a liquid to the nozzle of FIG. 1.
Figure 9:
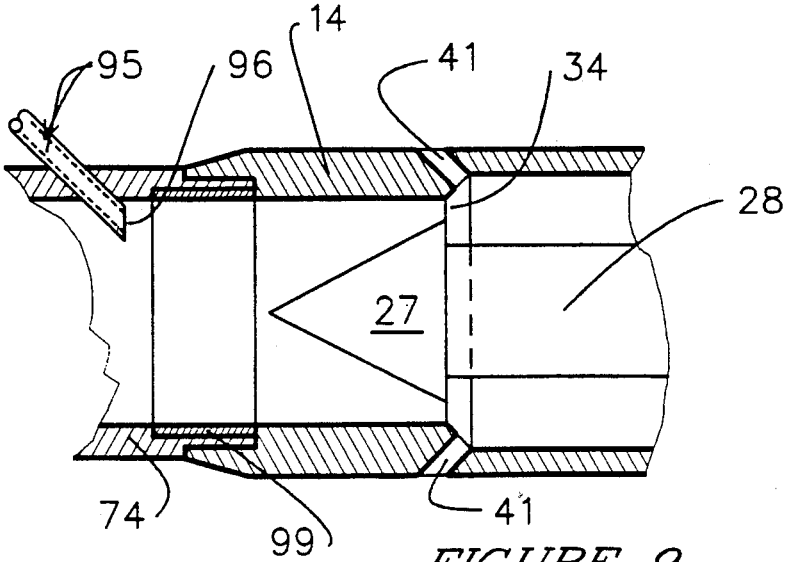
FIG. 9 is a fragmentary sectional view showing a preferred adaptation of the means of FIG. 7 for the introduction of a stream of particulate solids to the nozzle of FIG. 1.
Figure 7:
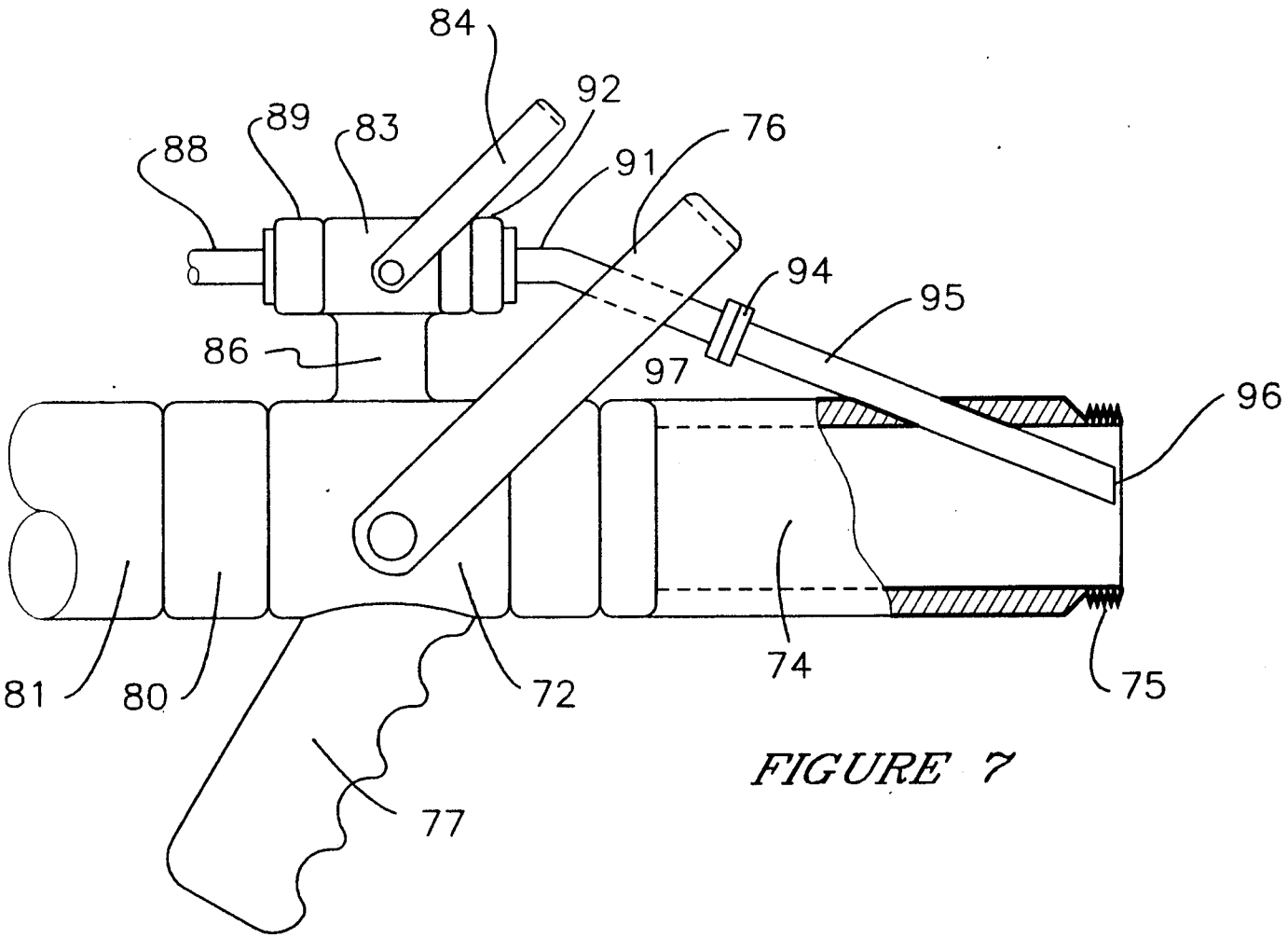
FIG. 7 is a view in partial section depicting accessory means for introducing a liquid foam concentrate or a dry powder into the water stream entering the nozzle of FIG. 1.

Turning now to FIGS. 7, 8 and 9, there is shown generally at 70 means for introducing and controlling a flow of liquid, which may be a foam concentrate, or a particulate solid which may be a fire extinguishing agent, into the nozzle of FIG. 1. Introduction means 70 includes a main flow control valve 72 having a barrel member 74 attached thereto at its forward, or downstream, end. Barrel member 74 terminates with a threaded section 75 adapted for connection to the threaded connector portion 15 of head member 14 (see FIG. 1) in the manner depicted in FIGS. 8 and 9.

Valve 72 may comprise a standard, multi-position slide valve having a control handle 76 and hand grip 77 of the type conventionally used in fire fighting. It is attached through connector 80 to a fire hose 81 or other conduit means suitable for supplying a stream of water or water mixed with a foam concentrate to valve 72 and thence to the nozzle 10. Associated with flow control valve 72 is an auxiliary control valve 83 having a control handle 84. It is preferred that auxiliary valve 83 be mounted atop pedestal 86 which in turn is fixed to the top of valve 72 in a spatial relationship such that handles 76 and 84 of valves 72 and 83 can be operated over their full range without interference one with the other. That configuration also allows convenient one-handed control of the two valves by the operator.

A stream of liquid or of particulate solids is delivered to auxiliary valve 83 by way of conduit 88 which is coupled to valve 83 by way of connector means 89. A discharge conduit 91 is coupled to the downstream end of auxiliary valve 83 through connector means 92. Conduit 91, in turn, is connected through flange 94 to injector tube 95. Injector tube 95 is of much smaller diameter than is barrel member 74, passes through the wall of that member at an oblique angle 97 to its axis, and terminates adjacent its downstream end. The discharge end 96 of injector tube 95 is preferably configured as a plane perpendicular to the axis of barrel member 74.

FIG. 8 depicts the adaptation of the means of FIG. 7 for the introduction of a liquid to a flowing water stream. In this embodiment, injector tube 95 is arranged such that the opening in discharge end 96 is aligned on the axis of barrel member 74 which axis is common to that of nozzle 10 when the two are assembled. Liquid discharged from injector tube 95 is centered on tip 29 and is dispersed into an accelerating water stream passing around head member 29 thus providing a rapid and thorough dispersion of the added liquid into the flowing water.

In fire fighting applications, introduction of a foam concentrate or liquid extinguishing agent through injector tube 95 provides considerable advantage as compared to conventional techniques. A foam concentrate would ordinarily be added to the water supplied to a nozzle by use of an eductor or metering pump at a location upstream and remote from the nozzle. Control of the foam flow then would be separate from control of the nozzle. In contrast, the instant invention gives total control of foam use to the fireman operating the nozzle.

A somewhat different configuration is preferred in those embodiments wherein particulate solids are introduced into a flowing water (or other liquid) stream and that adaptation is illustrated in FIG. 9. In this embodiment, the end 96 of injector tube 95 is again on a plane perpendicular to the axis of barrel 74 but preferably terminates at a point just through the barrel wall. The particulate solids may conveniently be introduced through injector tube 95 as a dense suspension in a carrier gas. For example, a dry chemical fire extinguishing agent may be supplied to the injector and nozzle means using a conventional gas-pressured dry chemical extinguisher as the source by coupling the discharge hose of the extinguisher to conduit 88.

As has been alluded to earlier, the particulate solids introduced into a flowing stream of liquid through use of the accessory means of FIGS. 7, 8 and 9 are not restricted to fire extinguishing agents or foam forming materials. Rather, those particulate solids may be abrasive materials which, when carried in a water stream propelled through nozzle 10, serve to effectively clean the surfaces of solids as, for example, the preparation of a steel surface for painting. In this embodiment, which can be considered a form of sand blasting, it is preferred that a replaceable liner 99 be provided within that portion of barrel 74 and head member 14 which are subject to abrasive wear through impingement of particulates entering through injector tube 95. Liner 99 is fabricated from a hard, wear resistant material such as silicon carbide. It may also be advantageous to fabricate head member 27 of stream shaping means 25 and other wear prone areas of nozzle 10 from the same material as is used for liner 99.

As has been set out before, injector tube 95 defines an oblique angle 97 with the axis of barrel member 74 as it passes through the barrel wall. The magnitude of angle 97 has a direct effect upon the performance of the injector means and proper selection of that angle alleviates the problem of plugging associated with prior art attempts to inject dry fire extinguishing agents into a water stream within a nozzle. In general, for the embodiments both of FIG. 8 and FIG. 9, injector tube 95 is set in relation to the axis of barrel 74 such that angle 97 is in the range of 20° to 60°. The most efficient and trouble free injector performance has been obtained when angle 97 is set between 30° and 45°. When the injector tube is set at an angle within that range and water is allowed to flow through injector means 70 and nozzle 10 at hydrant pressure, there is created a negative pressure or suction at valve 83 of one-half bar or even more.

Figure 10:
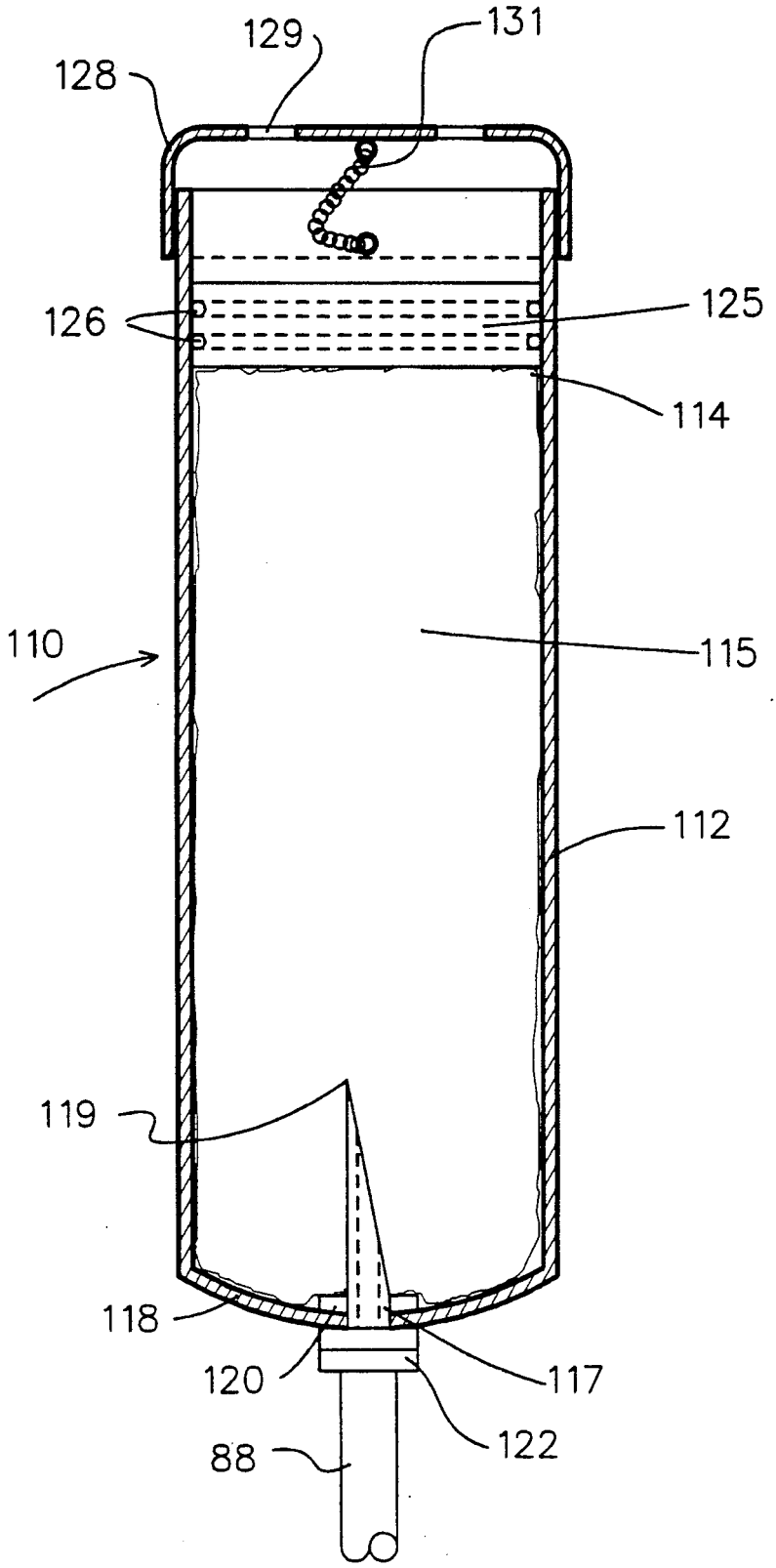
FIG. 10 is a sectional view of a liquid reservoir means which may be used to supply the liquid introduction means of FIGS. 7, 8 and 9.

Turning again to the embodiment of FIG. 8 employing a liquid foam concentrate for fire fighting, the concentrate is introduced into the system through auxiliary valve 83. In that event, a liquid concentrate may be supplied to valve 83 through conduit 88 by gravity feed or from a pressurized source vessel or pump. However, a preferred technique for providing a liquid foam concentrate or fire extinguishing solution to auxiliary valve 83 utilizes the liquid supply system 110 shown in FIG. 10.

System 110, shown in cross-section, comprises an opentopped container 112 of regular shape and having rigid walls. Container 112 is adapted for insertion of a flexible bag 114 filled with a liquid foam concentrate or fire extinguishing composition 115. Bag 114 conforms in size and shape to the interior of container 112 and may be fabricated from a film of a flexible plastic such as polypropylene or the like. A fluid exit means comprising a conduit member 117 extends upwardly through the bottom 118 of container 112 and terminates in a sharpened, piercing point 119. Conduit member 117 is held in place and sealed to the bottom 118 by means of flange 120 and connects to conduit 88 through attachment means 122.

Disposed atop liquid filled bag 114 is follower slide 125 which is sized for a sliding fit within container 112. A seal between the edge of slide 125 and the interior wall of container 112 is provided by one or more O-rings 126. Lid 128 covers the top of container 112 and is provided with one or more vent holes 129 which ensure that atmospheric pressure bears against the top of slide 125. A chain or other connecting means 131 attaches slide 125 to lid 128 so that the slide may easily be retrieved from a position at or near the bottom of container 112.

Liquid supply system 110 may be configured as a back pack for a fireman or may be carried on a cart or other conveyance. When system 110 is configured as a back pack, the container 112 is sized such that it can conveniently be carried yet contain enough foam concentrate or extinguishing agent to provide at least several minutes of supply when fighting a fire. In that mode connector means 89, which attach conduit 88 to valve 83, are preferably of the quick disconnect type so that a back pack containing a new supply of foam or extinguishing agent can quickly be exchanged for an exhausted one.

As may now be more fully appreciated, the means and methods of this invention, as set out in the disclosure, provide enhanced nozzle performance and other advantages not present in prior art devices and techniques. It will also be recognized by those skilled in this art that numerous modifications of the devices and techniques which have been described can be made without departing from the spirit and scope of the invention.

I claim:

1. An aspirating nozzle, comprising:

a nozzle body having an upstream end and a downstream end and a wall defining a generally cylindrical fluid passage between said ends, said fluid passage having a first zone of reduced cross sectional area at the upstream end, a second zone of enlarged cross sectional area downstream of said first zone, and a transition zone between said first and second zones;

a central stream shaping means positioned axially within said fluid passage, said stream shaping means having a head portion and a body portion, the head portion of said means being larger than the body portion but smaller than said first zone and extending into that zone to define an annular space of varying dimension between the stream shaping means and the inner surface of said nozzle wall and a constricted passage between said first and second zones, the body portion of said means extending beyond the downstream end of said transition zone;

a plurality of vanes extending between the body portion of said stream shaping means and said nozzle body wall, said vanes acting to hold said body portion fixed relative to said nozzle body; and port means adjacent said transition zone adapted for drawing a stream of ambient air into said fluid passage downstream of said stream shaping means head portion when a liquid is flowing through said passage.

2. The nozzle of claim 1 wherein said vanes are arranged at an angle relative to the longitudinal axis of said nozzle body so as to cause fluid passing through said nozzle to rotate about said longitudinal axis.

3. The nozzle of claim 2 wherein the vane angle is set such that a fluid column expelled from said nozzle makes one revolution for every 10 to 50 nozzle diameters.

4. The nozzle of claim 1 wherein said vanes are arranged in at least two sets, one said set being downstream of the other said set, all of the vanes in each said set being disposed at the same angle relative to the longitudinal axis of said nozzle.

5. The nozzle of claim 1 wherein the body portion of said stream shaping means is cylindrical and wherein the head portion of said stream shaping means is movable relative to the body portion of said means in a direction parallel to the longitudinal axis of said body portion.

6. The nozzle of claim 5 including spring means adapted to allow said head portion to move axially in a downstream direction as fluid flow within the nozzle is increased.

7. The nozzle of claim 1 wherein the head portion of said stream shaping means is configured as a cone having an apex and a base; wherein the apex angle of said cone is less than 75°; wherein the base of said cone is positioned adjacent said transition zone; and wherein said body portion extends beyond the downstream end of said nozzle body.

8. The nozzle of claim 7 wherein said conical head portion is sized such that the area of said constricted passage is less than one-half the area of said first zone.

9. The nozzle of claim 7 wherein the diameter of said body portion is between 60% and 90% of the diameter of said conical head member base and wherein said cone apex angle is less than 30°.

10. The nozzle of claim 1 wherein said nozzle body includes a third zone downstream of said second zone, said third zone being larger in cross-sectional area than said second zone and defining a second transition zone between said second and third zones, and a set of secondary ports extending through said nozzle wall adjacent said second transition zone to draw additional air into said fluid passage when a liquid is flowing therethrough.

11. The nozzle of claim 1 including flow control means disposed upstream of said first zone, said flow control means comprising a main valve for controlling the flow of liquid to said nozzle; an elongated, generally cylindrical housing defining a fluid passage disposed between said main valve and the upstream nozzle end; an auxiliary valve having an upstream end and a downstream end, the upstream end adapted for connection to a source of liquid or particulate solids; and an injector tube communicating between the downstream end of said auxiliary valve and the interior of said housing, said injector tube passing through the wall of said housing at an oblique angle, the discharge end of said tube terminating within said housing as a plane generally perpendicular to the longitudinal axis of said housing.

12. The nozzle of claim 11 including means for supplying a liquid fire control agent to said auxiliary valve, said means comprising a container of regular shape and having rigid walls; a flexible bag for the containment of a liquid fire control agent disposed within said container; piercing means disposed at the bottom of said container, said piercing means adapted to penetrate through the wall of said flexible bag and to provide liquid communication between the interior of said bag and the exterior of said container; and conduit means communicating between said piercing means and the upstream end of said auxiliary valve.

13. The nozzle of claim 12 wherein a following means comprising a sliding member conforming to the size and shape of the interior of said container is disposed atop said flexible bag, said sliding member progressing toward the bottom of said container as the flexible bag is emptied.

14. The nozzle of claim 11 wherein the longitudinal axis of said nozzle body and the longitudinal axis of said housing are aligned; wherein said auxiliary valve is arranged to control the flow of a liquid; wherein an opening in the discharge end of said injector tube is centered upstream of and adjacent to the head portion of said stream shaping means; and wherein said discharge end opening is aligned on said housing and nozzle axes.

15. The nozzle of claim 11 wherein the oblique angle at which said injector tube passes through the wall of said housing is between 30° and 45° relative to the axis of said housing.

16. The nozzle of claim 11 wherein said main valve and said control valve are each equipped with a handle to control flow therethrough; wherein said auxiliary valve is mounted atop said main valve and wherein the control handle of each said valve is positioned for operation over its full range without interference with the other while allowing for simultaneous one-handed control of both valves by an operator.

17. A method for producing an air aspirated liquid comprising:

passing said liquid through a nozzle, the crosssectional area of said nozzle increasing in a stepwise fashion as the liquid progresses through the nozzle;

directing the liquid to the inner nozzle wall as it passes a first point whereat the nozzle cross-sectional area increases to thereby form a liquid layer flowing along the inner nozzle wall and a zone of reduced pressure in the nozzle interior;

aspirating air from the outside of the nozzle through said liquid layer and into said zone of reduced pressure by way of ports located in the nozzle wall at that first point whereat the cross-sectional area increases;

imparting a rotation to the liquid and air as the streams progress down the nozzle; and discharging a coherent columnar stream of liquid and air from the nozzle.

18. The method of claim 17 wherein the cross-sectional area of said nozzle undergoes a second stepwise increase and wherein additional air is aspirated through said liquid layer and into the nozzle interior by way of additional ports located in the nozzle wall at the point of said second stepwise increase.

19. The method of claim 17 wherein said liquid comprises water containing a minor amount of a foam concentrate and wherein said aspirated air forms a dense foam having fire extinguishing properties.

20. The method of claim 17 wherein said liquid comprises water carrying a slurry of particulate solids, said solids selected from the group consisting of fire extinguishing agents and abrasive particles.

21. A flow control means for an air aspirating nozzle comprising:

a first valve for controlling the flow of water to said nozzle;

a housing defining a generally cylindrical fluid passage disposed at the outlet side of said first valve, said housing having a longitudinal axis and adapted for connection to an air aspirating nozzle at its downstream end;

an auxiliary valve having an inlet and an outlet, said inlet adapted for connection to a fluid source; and an injector tube, one end of said tube connected to the outlet of said auxiliary valve, said tube communicating between said auxiliary valve and the interior of said housing, said injector tube passing through the wall of said housing at an acute angle thereto, said acute angle as measured between the longitudinal axis of said housing and the longitudinal axis of said injector tube being between 20 and 60°, the other end of said tube terminating within said housing as a plane generally perpendicular to the longitudinal axis of said housing.

22. The flow control means of claim 21 wherein said auxiliary valve is mounted atop said first valve and wherein the control handle of each said valve is positioned for operation over its full range without interference with the other while allowing for simultaneous one-handed control of both valves by an operator.

23. The flow control means of claim 21 wherein said acute angle is between 30° and 45°.

24. The flow control means of claim 21 wherein said auxiliary valve is arranged to control the flow of a liquid and wherein the discharge end opening of said injector tube is centered on the longitudinal axis of said housing.

25. The flow control means of claim 21 wherein said auxiliary valve is arranged to control the flow of a gaseous suspension of particulate solids; wherein the discharge end opening of said injector tube is positioned above the longitudinal axis of said housing; and wherein the interior of said housing is lined with a wear resistant material downstream of said injector tube entry.

26. A system for supplying a liquid fire control agent to an air aspirating nozzle comprising;

an open-topped container having rigid walls;

a flexible bag for the containment of a liquid fire control agent disposed within said container;

piercing means disposed at the bottom of said container, said piercing means adapted to penetrate through the wall of said flexible bag and to provide a conduit between the interior of said bag and the exterior of said container;

a following means comprising a sliding member conforming to the size and shape of the interior of said container disposed atop said flexible bag, said sliding member arranged to move toward the bottom of said container as the flexible bag is emptied; and flexible conduit means for connection of said piercing means to a feed port of an air aspirating nozzle.

27. The system of claim 26 wherein said flexible conduit means includes a connector which may be quickly connected to and disconnected from said nozzle feed port.

* * * * *